United States Patent [19]

Yamamoto

[11] Patent Number: 4,907,399

[45] Date of Patent: Mar. 13, 1990

[54] AUTOMATIC PACKAGING METHOD

[75] Inventor: Masaru Yamamoto, Iruma, Japan

[73] Assignee: Omori Machinery Co., Ltd., Saitama, Japan

[21] Appl. No.: 193,274

[22] Filed: May 11, 1988

[30] Foreign Application Priority Data

May 13, 1987 [JP] Japan ..... 62-114483

[51] Int. Cl.[4] ..... B65B 9/06

[52] U.S. Cl. ..... 53/450; 53/493

[58] Field of Search ..... 53/450, 550, 493, 505, 53/51, 55

[56] References Cited

U.S. PATENT DOCUMENTS 4,506,488 3/1985 Matt ..... 53/450 X 4,549,386 10/1985 Wilson ..... 53/51

4,726,168 2/1988 Seko ..... 53/51 X

FOREIGN PATENT DOCUMENTS 84299 7/1983 European Pat. Off. ..... 53/51

*Primary Examiner*—John Sipos

*Attorney, Agent, or Firm*—Wenderoth, Lind & Ponack

[57] ABSTRACT

A band-shaped film of a suitable plastic material is conveyed and is formed into a tubular shape during its travel, articles to be packed are conveyed and transferred into the tubular film at intervals and the tubular film is sealed at a predetermined pitch into individual bags. The tubular film is fed at a substantially constant speed and each article is conveyed at about the same speed as that of the tubular film during at least a period in which the article is transferred into the tubular film.

3 Claims, 2 Drawing Sheets

AUTOMATIC PACKAGING METHOD

BACKGROUND OF THE INVENTION

1. Field of the Invention

The present invention relates to an automatic packaging method and, more particularly, to improvement in or relating to a method by which articles to be packed and being conveyed, e.g. such as by flights of conveying means, are successively put into a tubular bag of a film of synthetic resin or a suitable plastic material.

2. Description of the Prior Art

One typical packaging machine which is widely employed for automatic packaging of articles is a horizontal pillow type machine as shown in FIG. 1. This type automatic packaging machine comprises a conveying unit 3 equipped with flights 2 for conveying articles 1 to be packaged at predetermined intervals, an end sealer 4 disposed downstream of the conveying unit 3, and a film supply reel 6 having wound thereon a band-shaped film 5, e.g. such as of synthetic resin or a suitable plastic material. A plurality of film guide rollers 8 are disposed between the film supply reel 6 and the conveying unit 3, and a bag-making device 9 is disposed at a position adjacent the downstream end of the conveying unit 3. The film 5 wound on the supply reel 6 is drawn out therefrom and guided by the guide rollers 8 to the bag-making device 9, wherein it is formed into a continuous tube 10. The conveyer unit 3 includes an endless chain 11 to which the flights 2 are attached for movement therewith. Each article 1 is placed on the endless chain 11 with its rear end being in contact with the flight 2, so that the article 1 is forwarded from the left-hand side to the right-hand side in FIG. 1 as the endless chain 11 moves. At the downstream end of the conveying unit 3 the article 1 is received into the bag-making device 9 and is introduced into the film tube 10. Thereafter, the article 1 is carried by the film tube 10 to the end sealer 4 which is adapted to cut and seal the film in the transverse direction at a predetermined pitch, hereinafter referred to as the cut-pitch.

The traveling or running speed of the conveying unit 3 should be coordinated with the traveling or running speed of the end sealer 4 so that the latter may cut and seal the film at points between the adjacent articles 1. Usually, the pitch of the flights 2 is selected to be sufficiently large in order to permit articles of various sizes to be carried thereby, and therefore it is larger than the cut-pitch unless the article is of maximum size. Consequently, in the conventional machine the running speed of the conveying unit 3 is set higher than the traveling speed of the film tube 10 to make it possible to supply the articles 1 into the film tube 10 at a time interval during which the film travels a distance equal to the cut-pitch.

Such a higher speed of the conveying unit 3, however, causes the article 1 to be thrust into the film tube 10. Therefore, if the articles 1 are of a material having a small coefficient of friction, they tend to advance slidingly relative to the film tube 10 due to the force of inertia, thereby resulting in the articles 1 being placed at positions different from the intended positions between the adjacent cut points. On the contrary, if the articles 1 are of a material having a large coefficient of friction, they will not smoothly move into the film tube 10 and will tend to be jammed at the inlet of the device 9. Furthermore, in the case where the articles 1 are larger in height than the flights 2 and are liable to lose their shape, such as stacked ham slices, since only the upper portions thereof will rub against the film tube 10, the articles 1 will readily get out of shape when put into the film tube 10. These problems become more and more serious with an increase in the running speed of the machine for increasing the efficiency of a packaging operation.

It is therefore an object of the present invention to provide an automatic packaging method which is free from the above-mentioned defects of the prior art and which permits optimum automatic packaging for articles of various sizes.

SUMMARY OF THE INVENTION

According to the invention, an automatic packaging method comprises the steps of forming a band-shaped film into a tubular shape during travel of the film, conveying articles to be packed and transferring such articles into the tubular film at intervals, and sealing the tubular film at a predetermined pitch to provide individual bags. The film is fed at a substantially constant speed, while each article is conveyed at substantially the same speed as the tubular film during at least a period in which the article is transferred into the tubular film.

In one embodiment of the invention, each of the articles is conveyed at intervals longer than the pitch at which the tubular film is to be cut, and the conveying speed of each article is normally higher than the traveling speed of the tubular film and is reduced to substantially equal the film traveling speed during the transfer of the article.

The substantially equalized conveying speed ensures a smooth transfer of the article into the tubular film at a correct position and prevents the article from displacing in the tubular film.

Other objects, features and advantages of the invention will become apparent from the following description of preferred embodiments when taken in conjunction with the accompanying drawings.

DESCRIPTION OF THE PREFERRED EMBODIMENTS

Figure 1:
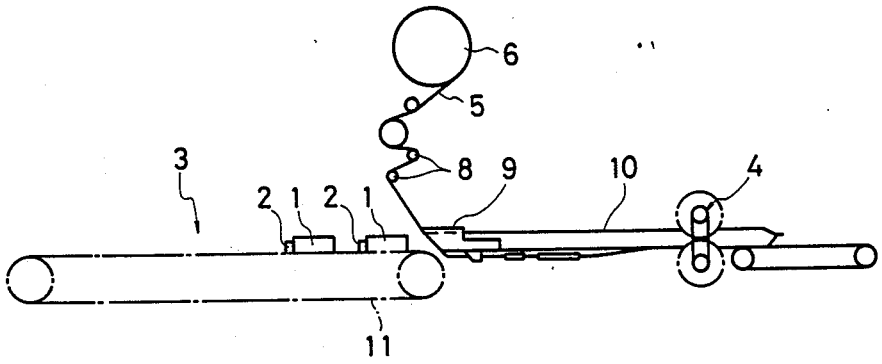
FIG. 1 PRIOR ART
FIG. 1 is a side view of a prior art packaging machine.
Figure 2:
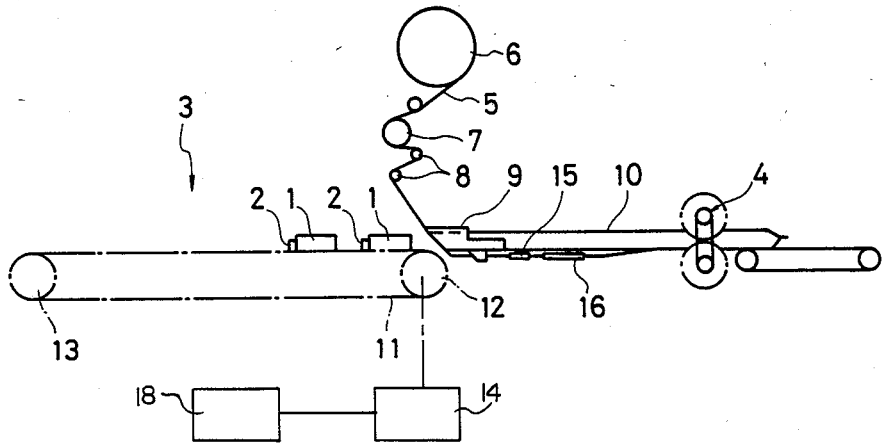
FIG. 2 is a side view showing an example of a packaging machine to which the present invention is applied.
Figure 3:
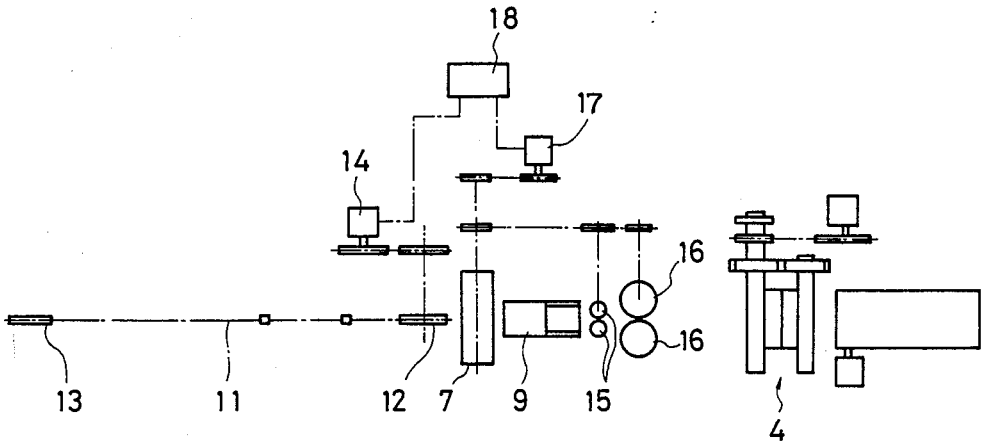
FIG. 3 is a plan view thereof.

FIGS. 2 and 3 illustrate, by way of example, a packaging machine to which a method of the present invention is applied. Since the machine of this embodiment is basically identical in construction with the conventional machine, the parts corresponding to those of the latter are identified by the same reference numerals.

As shown in FIGS. 2 and 3, an end sealer 4 is disposed ahead of a conveying unit 3 for conveying packaging articles 1 at predetermined intervals, and a film supply reel 6 having wound thereon a band-shaped film 5 is disposed above the conveying unit 3. The film 5 wound on the supply reel 6 is drawn out therefrom by a drawing-out roller 7 and guided across a plurality of tension rollers 8 to a bag-making device 9 which is disposed adjacent the downstream end of the conveying unit 3. The film 5 thus guided to the bag-making device 9 is formed into a tube 10 which continues to travel to the end sealer 4 as described hereinafter. The articles 1 fed by the conveying means 3 are introduced into the device 9 where the film tube 10 receives the articles 1 to carry the same downstream.

The conveying unit 3 comprises a pair of sprockets 12 and 13 and an endless chain 11 extending between the sprockets. A plurality of flights 2 are attached to the endless chain 11 at predetermined intervals so that the articles 1 placed on the chain 11 may be forwarded from the left-hand to the right-hand in FIG. 2 with the flights 2 being in contact with the rear ends of the articles 1. A first driving motor 14 is coupled to the sprocket 12 for driving the endless chain 11 and therefore moving the flights 2. The pitch of the flights 2 is selected sufficiently large in order to permit articles of different sizes to be conveyed, and therefore the flight pitch is usually larger than the cut pitch at which the film tube 10 is cut into individual packages by the end sealer 4.

Provided adjacent the outlet of the bag-making device 9 are a pir of rollers 15—15 which abut against each other to grip an overlapping longitudinal end of the film tube 10 therebetween and to feed the film tube 10 forwardly by their rotational movement. A pair of center sealers 16—16 are disposed ahead of the rollers 15 for sealing the overlapping end, the sealed end constituting a bottom center of the film tube 10. These rollers 15 and center sealers 16 are connected to and driven by a second drive motor 17 which also drives the drawing-out roller 7 via transmission means (not shown). Accordingly, the film traveling speed is determined by the running speed of the second motor 17.

Figure 4:
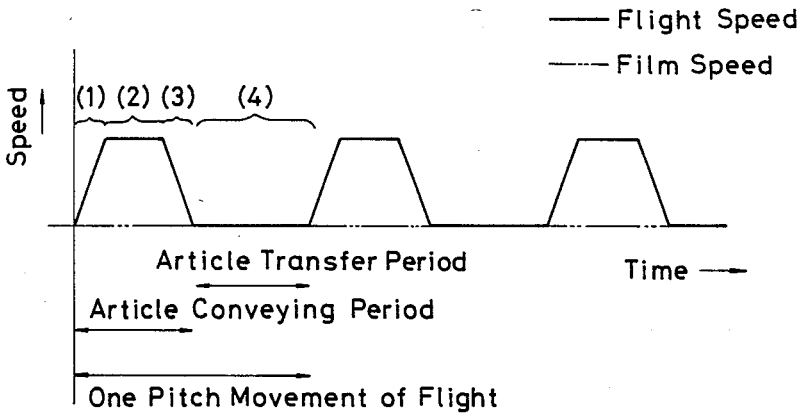
FIG. 4 is a graph showing the relationship between the moving speeds of flights and a film.

The first and second motors 14 and 17 are electrically connected to a control unit 18 which is adapted to control the running speeds of these motors. Specifically, under control of the unit 18, the second motor 17 for driving the drawing-out roller 7, etc. is driven at a substantially constant speed while speed of the first motor 14 for driving the conveying unit 3 is varied at such predetermined timing as depicted in FIG. 4. The control of the first motor 14 is such that the flight 2 moves at substantially the same speed as the film 5 during a period in which the article 1 is transferred from the conveying unit 3 to the film tube 10, as more fully described hereunder.

Next, an embodiment of the packaging method of the invention will be described in connection with the machine mentioned above. As the second motor 14 is driven at the constant speed, the band-shaped film 5 is drawn out from the film supply reel 6 by the rotation of the roller 7 also at the constant speed. Immediately after each article 1 is completely received in the film tube 10, the control unit 18 sends a signal to the first motor 14 to accelerate its running speed, and consequently the moving speed of the flights 2 increases (region (1)). The high-speed running (region (2)) for conveying the articles 1 at high speed continues until the foremost article approaches the bag-making device 9, and then the first motor 14 is decelerated (region (3)). The high-speed region (regions (1) to (3)) is to compensate for the difference between the pitch of the flights 2 and the cut-pitch of the film and to supply the article 1 into the film tube 10 at a predetermined time interval during which the preceding article 1 moves with the film tube 10 a distance equal to the cut pitch. The time set for each of the regions (1) to (3) is determined by various factors including the size of the article 1, the pitch of the flights 2 and the cut-pitch of the film tube 10.

The deceleration region (3) is so set that the moving speed of the flight 2 becomes substantially equal to the film traveling speed when the forward end of the article 1 reaches the film tube 10. This flight speed is maintained during a region 4 in which the article 1 is transferred into the film tube 10. Because the article 1 moves at substantially the same speed as the film during transfer, it does not displace relative to the film tube 10 and can be supplied thereinto at a correct position between the cut points. Upon completion of feeding the article 1 into the film tube 10, the flight 2 is restored to the high-speed running in preparation for feeding the next subsequent article into the film tube 10. Since the article 1 thus put into the film tube 10 is completely free from force applied thereto by the flight 2 when it is transferred into the tube 10, the article 1 is carried by the film tube 10 to the end sealer 4, wherein the film tube 10 is sealed and cut at points forward and rearward of the article 1 placed therein, to thereby provide a package.

While in the above embodiment the pitch of the flights is selected to be larger than the cut-pitch of the film tube, that is, the articles are conveyed at intervals greater than the cut-pitch, the present invention is not limited specifically to the above-described embodiment but may also be applied to a case where the pitch of the flights is smaller than the cut-pitch, that is, where the articles are conveyed at intervals shorter than the cut-pitch. In such a case, the conveying unit 3 is so controlled that each article is normally conveyed at a speed lower than that of the film tube and is accelerated to a speed equal to the film speed during a period of time in which the article is transferred into the film tube. Such a shorter pitch of the flight may be required in, for example, a case where a tall article is to be packed.

The control unit 18 in the illustrated embodiment comprises a micro-computer, but it is a matter of course that various electrical means or mechanical means such as a cam may be employed for effecting the speed changes of the conveying unit.

The film need be fed at a substantially constant speed, which means that a slight variation in speed may be allowable as long as it does not involve fluctuations of the film which will cause an article to be out of position in the film tube.

As described above, the method of the present invention permits smooth transfer of articles into the film tube because each of the articles is carried at substantially the same speed as the film when it is fed thereinto.

Although the invention has been described with regard to preferred embodiments thereof, it will be apparent that many modifications and variations may be effected without departing from the scope of the novel concepts of the invention.

What is claimed is:

1. An automatic method of packaging articles, said method comprising:

conveying a band-shaped film and forming said band-shaped film into a tubular shape during travel thereof;

conveying articles to be packaged and transferring said articles into said tubular film, said conveying comprising advancing said articles by abutting trailing ends of said articles with flights connected at predetermined equal intervals to a conveying;

sealing said tubular film at a predetermined pitch to thereby form individual bags having therein respective said articles;

said equal intervals between adjacent said flights being different from said predetermined sealing pitch;

maintaining the conveying speed of said film substantially constant; and controlling the speed of movement of each of said articles to normally be different than said conveying speed of said film, thereby to compensate for the difference between said flight interval and said sealing pitch, and adjusting said speed of movement of each said article to be equal to said conveying speed of said film during a period of time when said each article is transferred into said tubular film.

2. A method as claim in claim 1, wherein said flight interval is longer than said sealing pitch, and said controlling comprises normally maintaining said speed of movement of said articles higher than said conveying speed of said film and reducing said speed of movement of said articles during said period of time of transfer of each said article into said tubular film.

3. A method as claimed in claim 1, wherein said flight interval is shorter than said sealing pitch, and said controlling comprises normally maintaining said speed of movement of said articles lower than said conveying speed of said film and increasing said speed of movement of said articles during said period of time of transfer of each said aticle into said tubular film.

* * * * *